United States Patent [19]

Katoh

[11] Patent Number: 4,551,594

[45] Date of Patent: Nov. 5, 1985

[54] OIL PRESSURE SWITCH

[75] Inventor: Tadashi Katoh, Tokyo, Japan

[73] Assignee: Honda Giken Kogyo Kabushiki Kaisha, Tokyo, Japan

[21] Appl. No.: 619,791

[22] Filed: Jun. 12, 1984

[30] Foreign Application Priority Data

Jun. 20, 1983 [JP] Japan ..... 58-110675

[51] Int. Cl.[4] ..... H01H 35/40

[52] U.S. Cl. ..... 200/82 R; 200/81.9 R; 73/745; 340/60

[58] Field of Search ..... 200/81 R, 81.9 R, 82 R, 200/82 D; 73/745; 340/60, 605, 611, 626; 307/118; 361/178; 338/39

[56] References Cited

U.S. PATENT DOCUMENTS 3,704,458 11/1972 Buchanan ..... 200/81.9 R 3,758,733 9/1973 Du Rocher ..... 200/82 D

FOREIGN PATENT DOCUMENTS 441794 8/1912 France ..... 200/81.9 R

*Primary Examiner*—G. P. Tolin

*Attorney, Agent, or Firm*—Lyon & Lyon

[57] ABSTRACT

An oil pressure monitoring system for an engine having an oil pressure switch comprising a piston located in a port associated with the lubricating system of the engine. The piston is biased into the port by means of a spring. Located between the piston and the wall of the port so as to undergo compression with movement of the piston into the port is an elastic, electrical conductor ring. The ring is placed in series in a warning circuit and is so constructed that compression of the ring resulting from a drop in oil pressure within the lubricating system will affect conductivity through the ring to initiate a warning signal.

7 Claims, 4 Drawing Figures

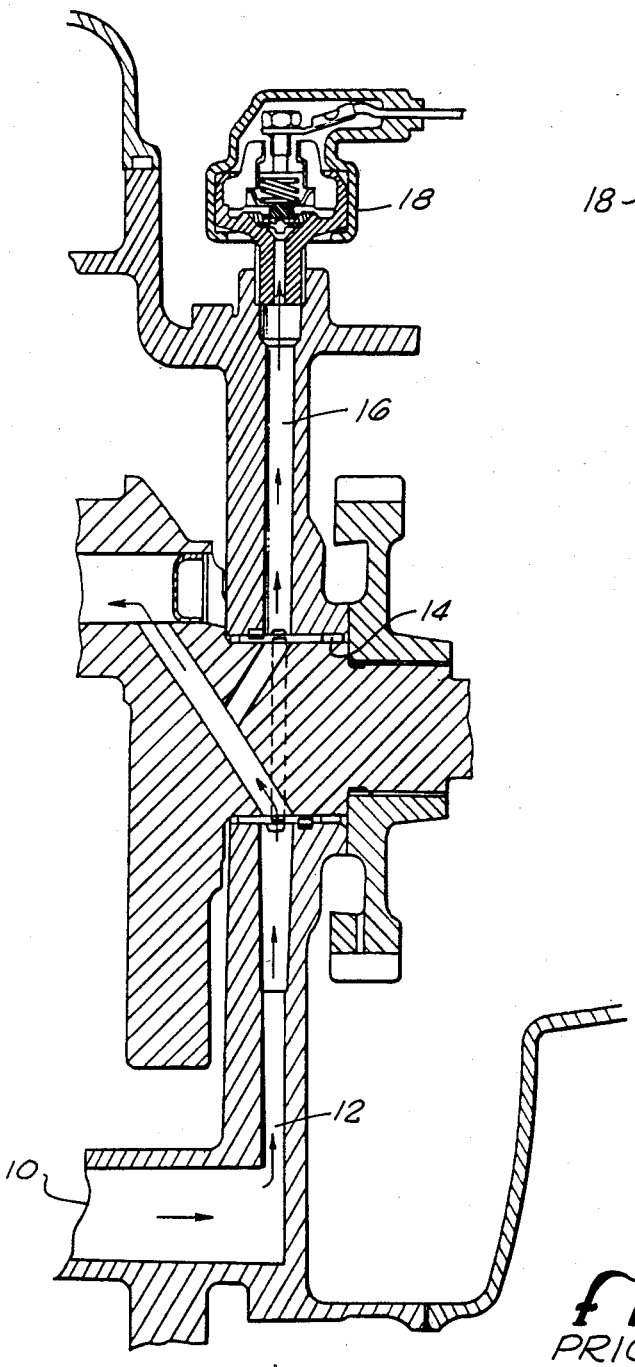
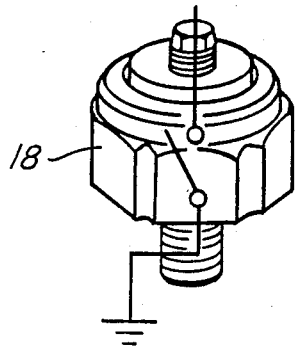
FIG. 2.
PRIOR ART
FIG. 1.
PRIOR ART

OIL PRESSURE SWITCH

BACKGROUND OF THE INVENTION

The field of the present invention is monitoring devices for sensing pressure in engine lubricating systems. Oil pressure sensing systems have long been employed in automobile engines and the like for sensing the pressure of the lubricant within the system. Such devices include warning systems which include a warning lamp which is activated by a reduction in pressure below a predetermined value. Thus, when oil pressure reaches a dangerously low level which would result in damage to the engine under continued operation, a warning light indicates the condition to the operator. Once such device is illustrated in FIGS. 1 and 2.

In FIG. 1, a cross section of an engine is illustrated with a lubricant supply system 10 directing oil through an oil hole 12 to a bearing 14. The oil continues through a sensor passage 16 to an oil switch 18. Extending outwardly from the engine case, the switch 18 is in communication with the sensor passage 16. A switch is schematically illustrated in FIG. 2. The switch may employ a spring which stretches back and forth and responds to changes of oil pressure above and below a preset level. A metal terminal communicates with the warning lamp circuit to provide a signal responsive to the movement of the spring.

The switch as illustrated in FIGS. 1 and 2 is commonly employed on automobiles and motorcycles. Because of the necessity to check and repair such switches, these switches are normally positioned such that they may be easily reached by a mechanic for checking and replacement. This location is often inconvenient, requires additional lubricant passages, is more expensive and may require placement in a disadvantageous position. The device of FIG. 1 provides an example of these difficulties where the engine case must be cored or drilled and tapped to provide for the convenient location of the switch which is awkwardly extending from the engine.

SUMMARY OF THE INVENTION

The present invention is directed to an improved lubricant pressure switch for employment in engines. The device includes a piston positioned within a port in the lubricant system. The piston is biased into the hole with an elastic, electrical conductor arranged to be compressed by the spring when lubricant pressure reaches a predetermined value. The elastic, electrical conductor is constructed to vary conductance responsive to compression so as to act as a switch for a warning circuit.

The employment of the simple piston mechanism allows the oil pressure switch to be located within the engine case. The mechanism avoids awkward placement of the switching device, is able to employ a simple port through a wall of the lubricant system, is inexpensive and provides reliable operation.

Accordingly, it is an object of the present invention to provide an improved oil pressure switch for lubricated engines. Other and further objects and advantages will appear hereinafter.

BRIEF DESCRIPTION OF THE DRAWINGS

FIG. 1 is a cross-sectional elevation of an engine employing a prior art oil pressure switch.

FIG. 2 is a schematic illustration of an oil pressure switch of the prior art.

DETAILED DESCRIPTION OF THE PREFERRED EMBODIMENT

Figure 4:
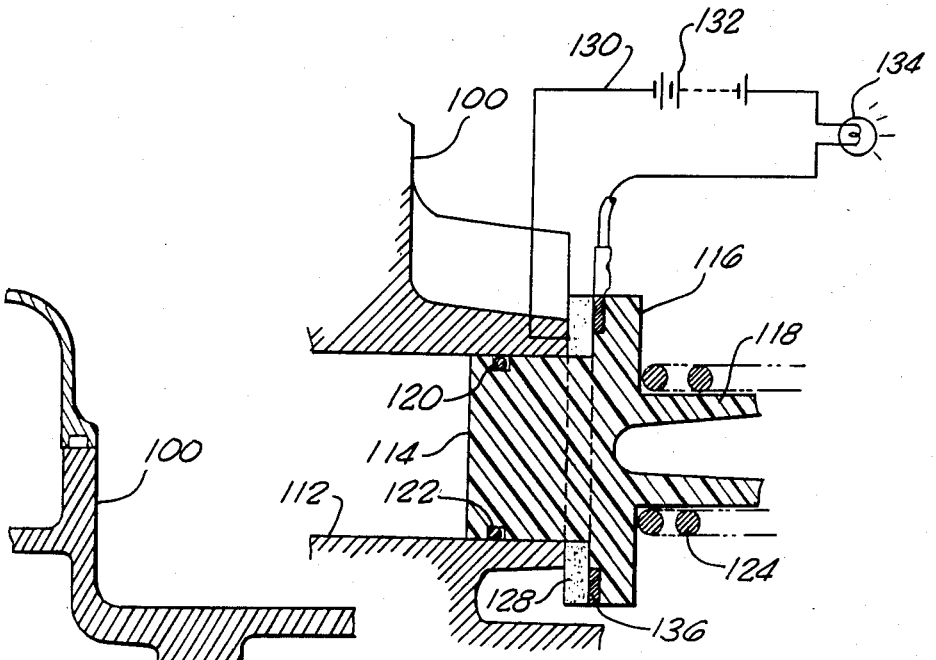
FIG. 4 is a cross-sectional detail of the oil pressure switch as illustrated in FIG. 3.
Figure 3:
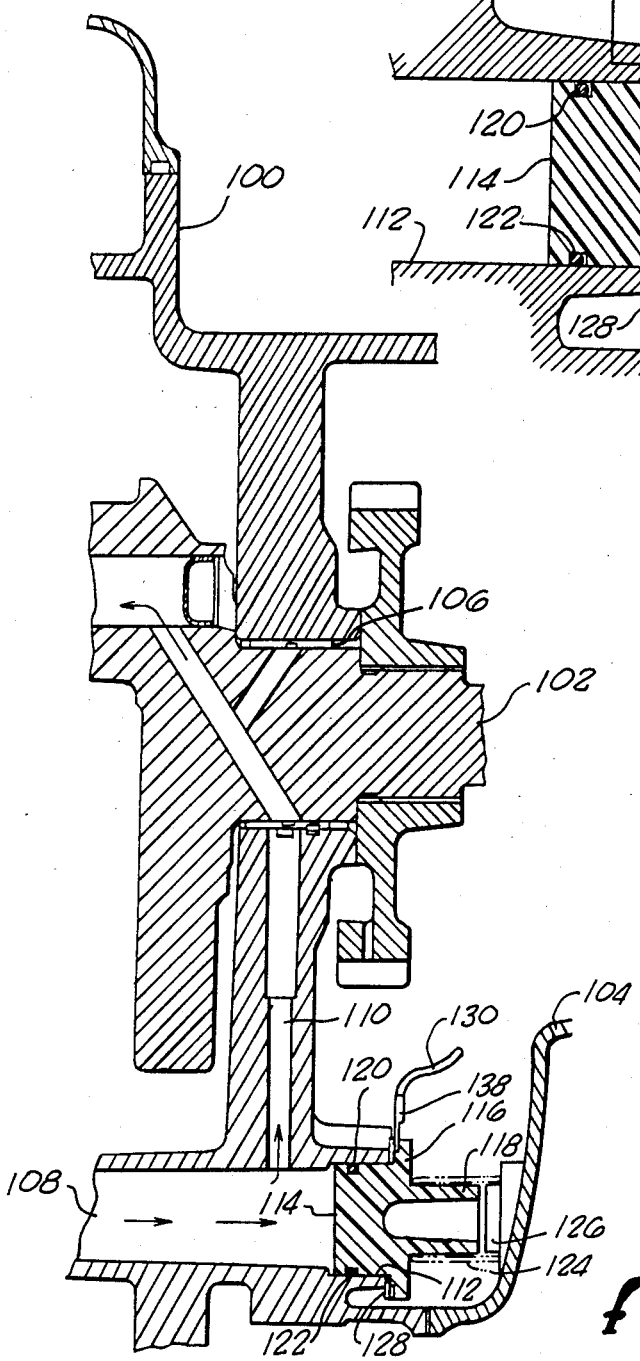
FIG. 3 is a cross-sectional elevation of an engine with an oil pressure switch of the present invention.

Turning in detail to the drawings, FIG. 3 illustrates an engine employing the oil pressure switch of the present invention. The engine includes an engine case 100 supporting and rotatably mounting a crankshaft 102. An engine cover 104 is mated with the engine case 100 to cover portions thereof. A lubricant supply system for the engine is illustrated as extending through the engine case 100 to supply lubricant to a bearing 106 for the crankshaft 102 as well as other components. The lubricant supply system includes a lubricant passage 108 distributing pressurized lubricant to an oil hole 110. Through the wall of the lubricating system formed in the engine case 100 is a port 112. The port 112 is subjected to the pressure of the circulating lubricant within the system. In this way, access is provided for sensing of the lubricant pressure within the system.

Positioned within the port 112 is a piston 114. The piston 114 is conveniently cylindrical and is sized to closely fit within the port 112 with sufficient clearance to allow sliding of the piston 114. The piston 114 includes an annular flange 116 which extends radially outwardly of the port 112 as can be seen in FIG. 3. A mounting boss 118 extends axially beyond the annular flange 116.

To seal the piston 114 within the port 112 so as to avoid oil flow from the lubrication system, a sealing groove 120 extends about the periphery of the body of the piston 114. An 0-ring 122 is illustrated in the preferred embodiment as being positioned within the sealing groove 120. If under low oil pressure conditions there is excessive resistance to sliding of the piston 114 in the port 112 with an oil ring seal, a flexible labyrinth seal may be incorporated in its place.

A means for biasing the piston 114 into the port 112 is employed to counteract the lubricant pressure within the engine lubricating system. To this end, a coil spring 124 is positioned about the mounting boss 118 in a coaxial arrangement with the piston. A spring mount 126 is provided on the engine cover 104 in alignment with the mounting boss 118 for receipt of the other end of the spring 124. The spring is preferably placed under some compression depending upon the range of oil pressures anticipated within the lubricating system.

Positoned adjacent the flange 116 and between the flange and the wall of the engine lubricating system is a elastic, electrical conductor ring 128. The conductor ring 128 is of the type which exhibits a change in conductivity resulting from compression of the body of the conductor. As such, predictable and rapid changes in conductivity through the material are found to occur under a small range of compression forces. With the conductor ring 128 positioned between the piston 114 and the wall of the lubricating system defined by the engine case 100, forced movement of the piston 114 into the port 112 will result in compression on the conductor ring 128. At some small range in that forced compression, a significant change in conductivity of the conductor ring 128 will take place.

To employ the properties of the conductor ring 128 for use in sensing a drop of oil pressure within the lubricating system below a certain value, forces on the piston must be considered. Forcing the piston 114 into the port 112 is the spring 124. The spring 124 is under sufficient precompression to establish a higher level of conductivity within the conductor ring 128 when there is no oil pressure within the lubricating system. When pressure is established within the lubricating system, the pressure operates against the surface area of the inner end of the piston 114 to counteract the force of precompression of the spring 124. As an example, the threshold pressure for activation of the warning signal in an engine may be set at 0.3 $kg/cm^2$. Above that value, the pressure of the lubricant forces the piston 114 against the force of the spring 124 to relieve compression on the conducting ring 128. Below that pressure, the spring 124 provides sufficient compression to significantly increase the conductivity of the conductor ring 128.

A monitoring circuit is provided for receiving or sensing the change in conductivity of the conductor ring 128. Located in series is circuit wiring 130, a voltage source 132, a warning lamp 134 and the conductor ring 128. The conductor ring 128 acts as a switch within the circuit to allow the voltage source 132 to light the warning lamp 134. The engine case 100 may be established at ground with the wiring not actually extending to the conductor ring 128. To provide sufficient contact with the conductor ring 128, a washer 136 of conductive material is positioned adjacent the conductor ring 128 in a recess provided in the annular flange 116 of the piston 114. The washer is coupled with the circuit through a terminal 138. The piston 114 is preferably of a synthetic resin polymer such that it will act as an insulator to avoid interfering with the warning circuit.

Accordingly, an improved oil pressure switch is disclosed which is easily fabricated, positioned in a convenient, out-of-the-way location and is of an uncomplicated and reliable design. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. An oil pressure switch for an engine lubricating system, comprising a port through a wall of the lubricating system;

a piston slidably mounted in said port;

a spring bias means for biasing said piston into said port;

an elastic, electrical conductor exhibiting a change in conductivity under compression, said elastic, electrical conductor being between said piston and the lubricating system wall for compression by said spring bias means; and a monitoring circuit including said conductor in series.

2. The oil pressure switch of claim 1 wherein said conductor is a ring and said piston includes an annular flange, said conductor ring being positioned between said flange and the wall of the lubricating system about the periphery of said port.

3. The oil pressure switch of claim 1 wherein said spring bias means includes a spring coaxially extending to said piston and a spring mount in the engine fixing one end of said spring, said spring being in precompression.

4. The oil pressure switch of claim 1 wherein said piston includes sealing means between said piston and the side of said port.

5. The oil pressure switch of claim 1 wherein said circuit includes a lamp, a voltage source and circuit wiring in series with said conductor.

6. The oil pressure switch of claim 1 wherein said spring bias means, said piston cross-sectional area and said conductor are selected to provide activation of said monitoring circuit with lubricant pressure at a preselected value.

7. An oil pressure switch for an engine lubricating system, comprising a port through a wall of the lubricating system;

a piston slidably mounted in said port, said piston including an annular flange;

a spring coaxially extending to said piston, said spring being in precompression for biasing said piston into said port;

an elastic, electrical conductor ring exhibiting a change in conductivity under compression, said conductor ring being positioned between said flange and the wall of the lubricating system about the periphery of said port; and a monitoring circuit including said conductor ring.

* * * * *